US009627161B2

(12) United States Patent
Yamamoto

(10) Patent No.: US 9,627,161 B2
(45) Date of Patent: Apr. 18, 2017

(54) OPERATING SWITCH

(71) Applicant: Panasonic Intellectual Property Management Co., Ltd., Osaka (JP)

(72) Inventor: Tamotsu Yamamoto, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 250 days.

(21) Appl. No.: 14/410,104

(22) PCT Filed: Jul. 19, 2013

(86) PCT No.: PCT/JP2013/004414
§ 371 (c)(1),
(2) Date: Dec. 21, 2014

(87) PCT Pub. No.: WO2014/024394
PCT Pub. Date: Feb. 13, 2014

(65) Prior Publication Data

US 2015/0325392 A1 Nov. 12, 2015

(30) Foreign Application Priority Data

Aug. 8, 2012 (JP) ..... 2012-175708

(51) Int. Cl.
*H01C 10/10* (2006.01)
*H01H 21/18* (2006.01)
(Continued)

(52) U.S. Cl.
CPC ..... *H01H 21/18* (2013.01); *H01H 21/24* (2013.01); *H01H 25/041* (2013.01); *H01H 2221/012* (2013.01); *H01H 2239/078* (2013.01)

(58) Field of Classification Search
CPC ..... H01H 21/18; H01H 21/24; H01H 25/041
(Continued)

(56) References Cited

U.S. PATENT DOCUMENTS 6,067,005 A * 5/2000 DeVolpi ..... G05G 9/047 200/512
7,087,848 B1 * 8/2006 Yamasaki ..... B60K 37/06 200/18

(Continued)

FOREIGN PATENT DOCUMENTS

JP 11-213818 8/1999
JP 2002-270070 9/2002

(Continued)

OTHER PUBLICATIONS

International Search Report of PCT application No. PCT/JP2013/004414 dated Aug. 13, 2013.

*Primary Examiner* — Kyung Lee
(74) *Attorney, Agent, or Firm* — McDermott Will & Emery LLP

(57) ABSTRACT

A multi-directional operating switch to be used chiefly for operating a variety of electronic apparatuses is disclosed. This operating switch can determine a tilt angle of an operating body accurately. The operating switch comprises a fixed electrode body, a movable electrode body made of conductive material, and the operating body. The fixed electrode body includes a first fixed electrode on its top face. The movable electrode body is disposed on the fixed electrode body and includes a first pressing projection protruding toward the first fixed electrode. The operating body is disposed on the movable electrode body and can be tilted such that it presses the first pressing projection from above. The movable electrode body is elastic, so that the first pressing projection can be deformed such that an electrostatic capacity generated between the first pressing projection and the first fixed electrode can be changed.

5 Claims, 9 Drawing Sheets

(51) Int. Cl.
*H01H 21/24* (2006.01)
*H01H 25/04* (2006.01)

(58) Field of Classification Search
USPC ..... 338/47, 68; 200/600
See application file for complete search history.

(56) References Cited

U.S. PATENT DOCUMENTS

| | | | | |
|---|---|---|---|---|
| 8,519,281 | B2 * | 8/2013 | Mizushima | G06F 3/03547 178/18.06 |
| 8,586,882 | B2 * | 11/2013 | Tanaka | G06F 3/04892 200/5 A |
| 8,638,541 | B2 * | 1/2014 | Mizushima | G01L 1/142 361/273 |
| 2002/0050919 | A1 * | 5/2002 | Vance | H01H 13/70 338/47 |
| 2010/0193341 | A1 * | 8/2010 | Uotani | G06F 3/0338 200/5 A |
| 2015/0325392 | A1 * | 11/2015 | Yamamoto | H01H 25/041 200/17 R |

FOREIGN PATENT DOCUMENTS

| | | |
|---|---|---|
| JP | 2003-114757 | 4/2003 |
| JP | 2005-038623 | 2/2005 |
| JP | 2012-012695 | 1/2012 |

* cited by examiner

OPERATING SWITCH

CROSS-REFERENCE TO RELATED APPLICATIONS

The present application is a U.S. national stage application of PCT International Application No. PCT/JP2013/004414 filed on Jul. 19, 2013 and claims the benefit of foreign priority of Japanese Patent Application No.2012-175708 filed on Aug. 8, 2012, the contents all of which are incorporated herein by reference.

TECHNICAL FIELD

The present invention relates to an operating switch to be used chiefly in a variety of electronic devices for operating them.

BACKGROUND ART

In recent years, portable electronic devices such as portable phones, or vehicle electronic devices such as car-navigation systems, audio systems have been sophisticated and diversified. This market trend requires a multi-directional operating switch operable at a high speed and easy to use.

A conventional multi-directional operating switch is described with reference to FIG. 8 and FIG. 9.

FIG. 8 is a sectional view of conventional multi-directional operating switch 20 that includes wired board 1, two push-switches 2, pressure sensitive body 3, detecting pin 4, elastic body 5, two pins 6, case 7, operating body 8, and cover 9.

Two push-switches 2 are disposed on a top face of wired board 1, and pressure sensitive body 3 is disposed between two push-switches 2. A press on pressure sensitive body 3 will change its resistance value. Detecting pin 4 is disposed on a top face of pressure sensitive body 3.

Detecting pin 4 includes pressing section 4A at an underside of pin 4, pillar section 4B, and projecting section 4C at an upper end of pillar section 4B.

Elastic body 5 covers two push-switches 2 and detecting pin 4. Elastic body 5 is made of, e.g. rubber, and shapes like a box, and its underside is open and its top face has a circular opening. Two pins 6 are disposed on a top face of elastic body 5 and above each of push-switches 2. Case 7 covers two pins 6 and elastic body 5. Case 7 shapes like a box of which underside is open and top face includes a circular opening.

Operating body 8 includes trunk section 8A, pressing arm sections 8B on both sides (left and right), pivot section 8C, operating section 8D, and rocking section 8E. Operating body 8 can tilt to both sides on pivot section 8C. An underside of each of pressing arm sections 8B is brought into contact with a top face of each of pins 6. A tilt of operating body prompts pressing arm section 8B to push an upper end of pin 6 at the underside.

Cover 9 includes circular opening 9A at its top face, and covers operating body 8 such that operating section 8D protrudes from circular opening 9A.

FIG. 9 is a sectional view of multi-directional operating switch 20 thus structured. As shown in FIG. 9, when an operator tilts operating section 8D to the right, pressing arm section 8B on the right pushes pin 6, whereby push switch 2 is depressed via elastic body 5. Push switch 2 is thus turned to an ON state.

At the same when push switch 2 is pushed, rocking section 8E pushes projection 4C of detecting pin 4, whereby pressure sensitive body 3 is pushed. A press onto pressure sensitive body 3 reduces a resistance value of pressure sensitive body 3, so that a tilt angle of operating section 8D can be determined.

An ON/OFF of push switch 2 of multi-directional operating switch 20 and the resistance value of pressure sensitive body 3 allow determining a tilt direction and a tilt angle of operating section 8D. A presence of this multi-directional operating switch 20 in an electronic apparatus (not shown) allows changing a scroll direction and a scroll speed, or a moving direction and a moving speed of a selected icon displayed on a display screen of the electronic apparatus.

Patent literature 1 is known as one of related art literatures.

Citation List: Patent Literature 1. Unexamined Japanese Patent Application Publication No. 2012-12695

SUMMARY OF THE INVENTION

The change in the resistance value of the pressure sensitive body relative to the tilt angle disperses so great that an accuracy of determining the tilt angle is obliged to be not so high. As a result, it has been difficult to adjust the scroll speed of the display or the moving speed of the selected icon when the display exhibits content at a finer quality.

The present invention addresses the foregoing problem, and aims to provide an operating switch that can determine a tilt angle accurately. The operating switch comprises a fixed electrode body, a movable electrode body made of conductive material, and an operating body. The fixed electrode body includes a first fixed electrode on its top face, and the movable electrode body is disposed on the fixed electrode body and includes a first pressing projection protruding toward the first fixed electrode. The operating body is disposed on the movable electrode body and can be tilted such that it presses the first pressing projection from the above. Movable electrode body 23 is elastic, so that it can be deformed such that an electrostatic capacity generated between the first pressing projection and the first fixed electrode can be changed.

The operating switch of the present invention thus can accurately determine the tilt angle of the operating body.

DESCRIPTION OF EMBODIMENTS

An exemplary embodiment of the present invention is demonstrated hereinafter with reference to FIG. 1-FIG. 7.

Exemplary Embodiment

Figure 1:
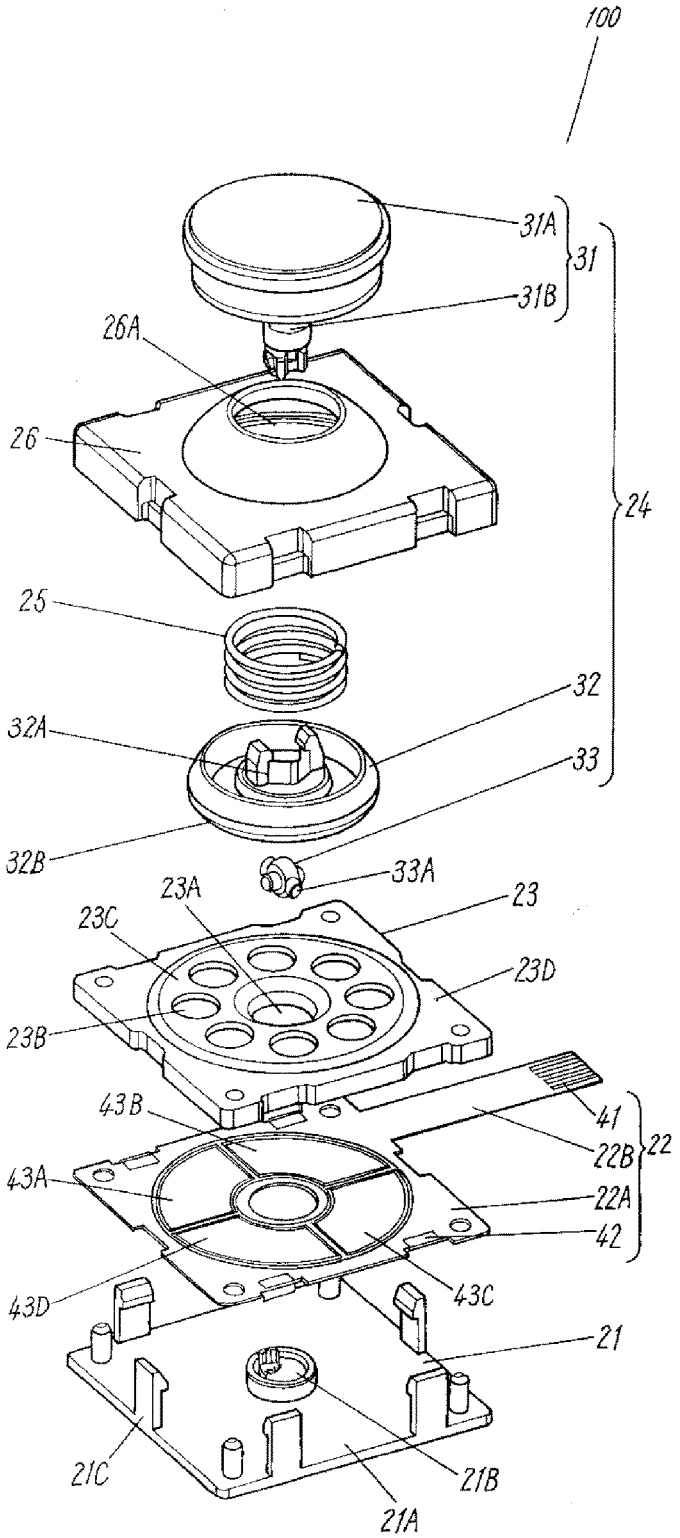
FIG. 1 is an exploded perspective view of a multi-directional operating switch in accordance with an embodiment.
Figure 2:
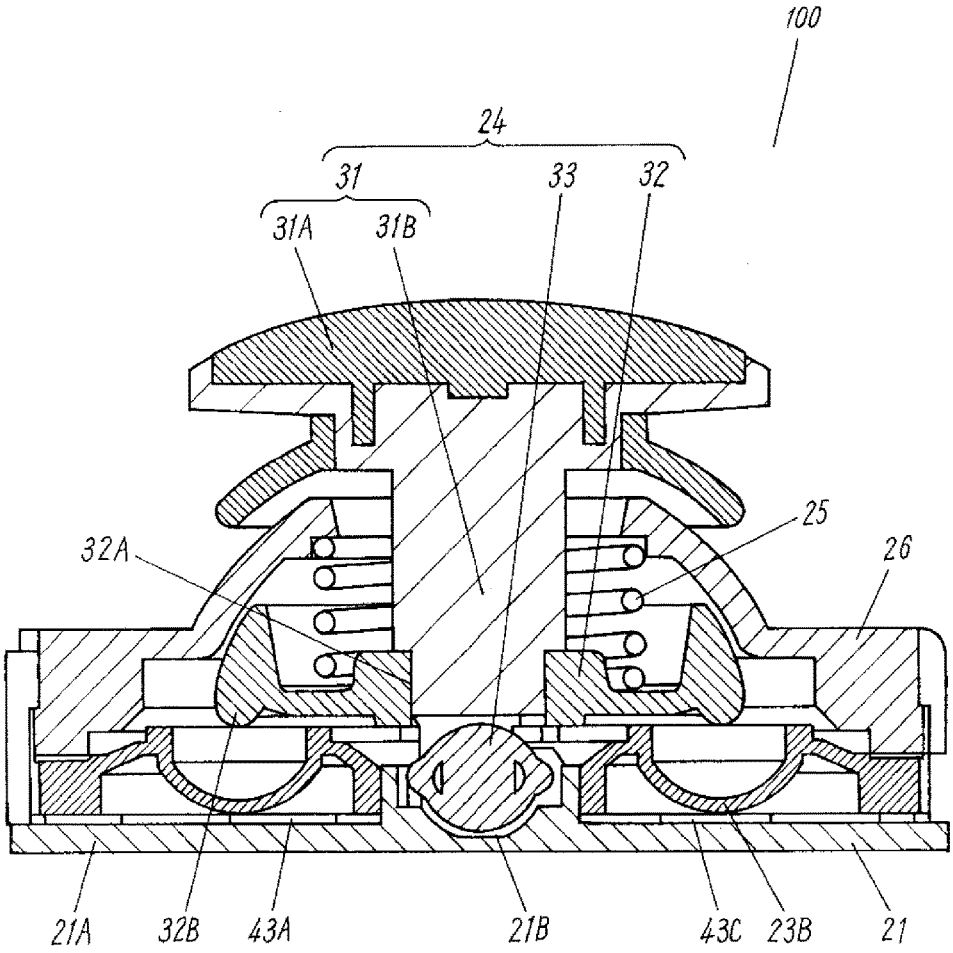
FIG. 2 is a sectional view of the multi-directional operating switch in accordance with an embodiment.

FIG. 1 is an exploded perspective view of a multi-directional operating switch in accordance with the embodiment. FIG. 2 is a sectional view of the multi-directional operating switch in accordance with the embodiment. In FIG. 1 and FIG. 2, multi-directional operating switch 100 includes lower case 21, fixed electrode body 22, movable electrode body 23, operating body 24, spring 25, and upper case 26.

Operating body 24 includes operating section 31, pressing section 32, and tilting section 33. Lower case 21 includes square flat plate 21A, bearing section 21B, and locking tabs 21C. Bearing section 21B includes a cylindrical wall disposed at the center of flat plate 21A. Locking tabs 21C protrude upward from the four sides of flat plate 21A.

Fixed electrode body 22 is formed of a flexible circuit board and includes electrode-placement section 22A having a square shape on which electrodes are disposed, and cable section 22B extending from electrode-placement section 22A. Cable section 22B includes multiple wirings inside thereof, and first ends of the wirings are disposed as terminal 41 at the right end of cable section 22B, and second ends of the wirings extend into electrode-placement section 22A. The second ends of the wirings are connected to four grounding electrodes 42 each having a square shape and four fixed electrodes 43A-43D each having a fan shape or a sector shape (first to fourth fixed electrodes). Grounding electrode 42 and fixed electrodes 43A-43D are electrically conductive, and they are preferably made of conductive metal such as copper or silver.

The top faces of fixed electrodes 43A-43D are covered with insulating layers (not shown). However, the top faces of grounding electrodes 42 are not covered with insulating layers. Grounding electrodes 42 are brought into contact with conductive movable electrode body 23, and a stable electrical connection to movable electrode body 23 is expected.

Movable electrode body 23 is made of elastic conductive material such as conductive rubber, which is formed by adding conductive carbon black or metallic powder to a rubber material such as natural rubber, synthetic rubber. The rubber material can be selected from, e.g. silicone rubber, isoprene rubber, natural rubber, chloroprene rubber, acrylic rubber, nitrile rubber, or ethylene propylene diene rubber.

Figure 3A:
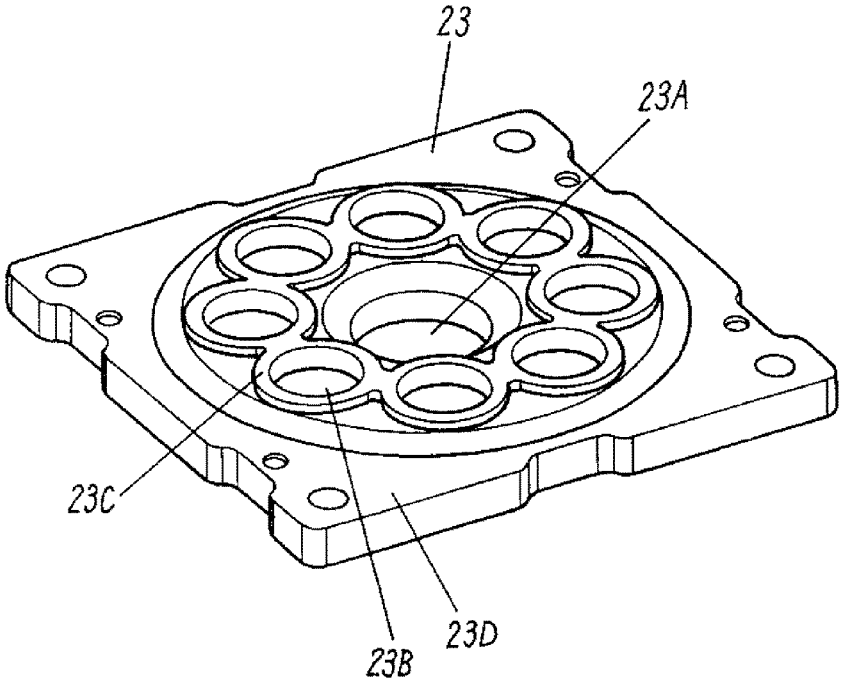
FIG. 3A is a perspective view of a movable electrode body of the multi-directional operating switch in accordance with an embodiment.
Figure 3B:
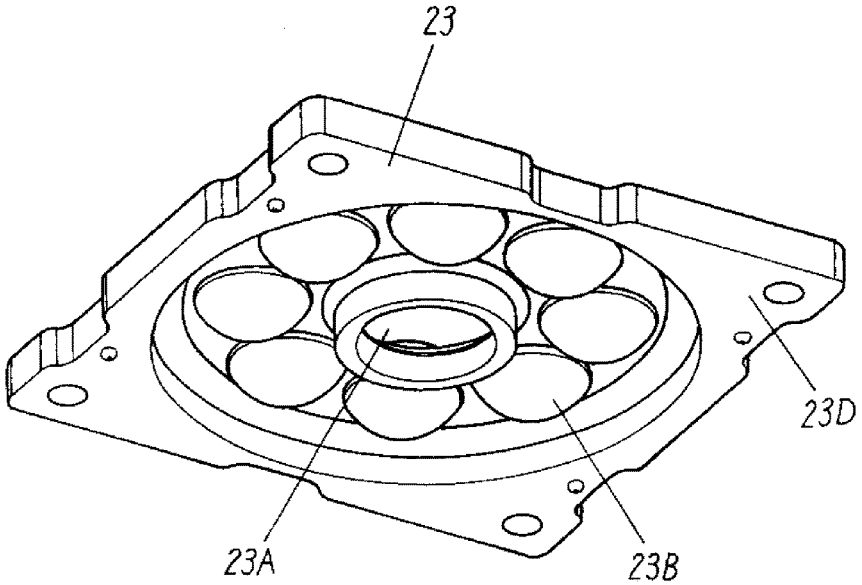
FIG. 3B is a perspective view of a movable electrode body of a multi-directional operating switch in accordance with an embodiment.

FIG. 3A is a perspective view of movable electrode body 23 viewed from above, and FIG. 3B is a perspective view of movable electrode body 23 viewed from below.

As FIG. 3A shows, movable electrode body 23 includes circular opening 23A at the center. Eight hemispherical pressing projections 23B (first to fourth pressing projections) are equidistantly placed around circular opening 23A, and they project downward. Movable electrode body 23 includes top face section 23C around pressing projections 23B, and also includes flat section 23D stepped-down from top face section 23C via a slope. As FIG. 3B shows, pressing projections 23B, the periphery of opening 23A inside flat section 23D are caved in. Placement of movable electrode body 23 on the top face of fixed electrode body 22 causes the underside of flat section 23D to touch grounding electrodes 42, so that the entire movable electrode body 23 has the grounding potential. Each of the undersides of pressing projections 23B of movable electrode 23 is brought into contact with each of the insulating layers disposed on fixed electrodes 43A-43D. Since each of pressing projections 23B is thinner than flat section 23D, projections 23B can be easily deformed when top face section 23C is depressed from the above.

The bottom ends of pressing projections 23B are located along a circumference of a circle concentric with circular opening 23A. A tilt of operating body 24 pushes top face section 23C around pressing projections 23B, whereby pressing projections 23B are urged to fixed electrode body 22 and are deformed. At this time, since eight pressing projections 23B are generally located equidistantly relative to a fulcrum for a tilt of operating body 24, this structure prevents the deformations of pressing projections 23B depending on a tilt direction from dispersing. In other words, the pressing force necessary for tilting the operating body 24 in some direction can be prevented from dispersing.

Figure 4:
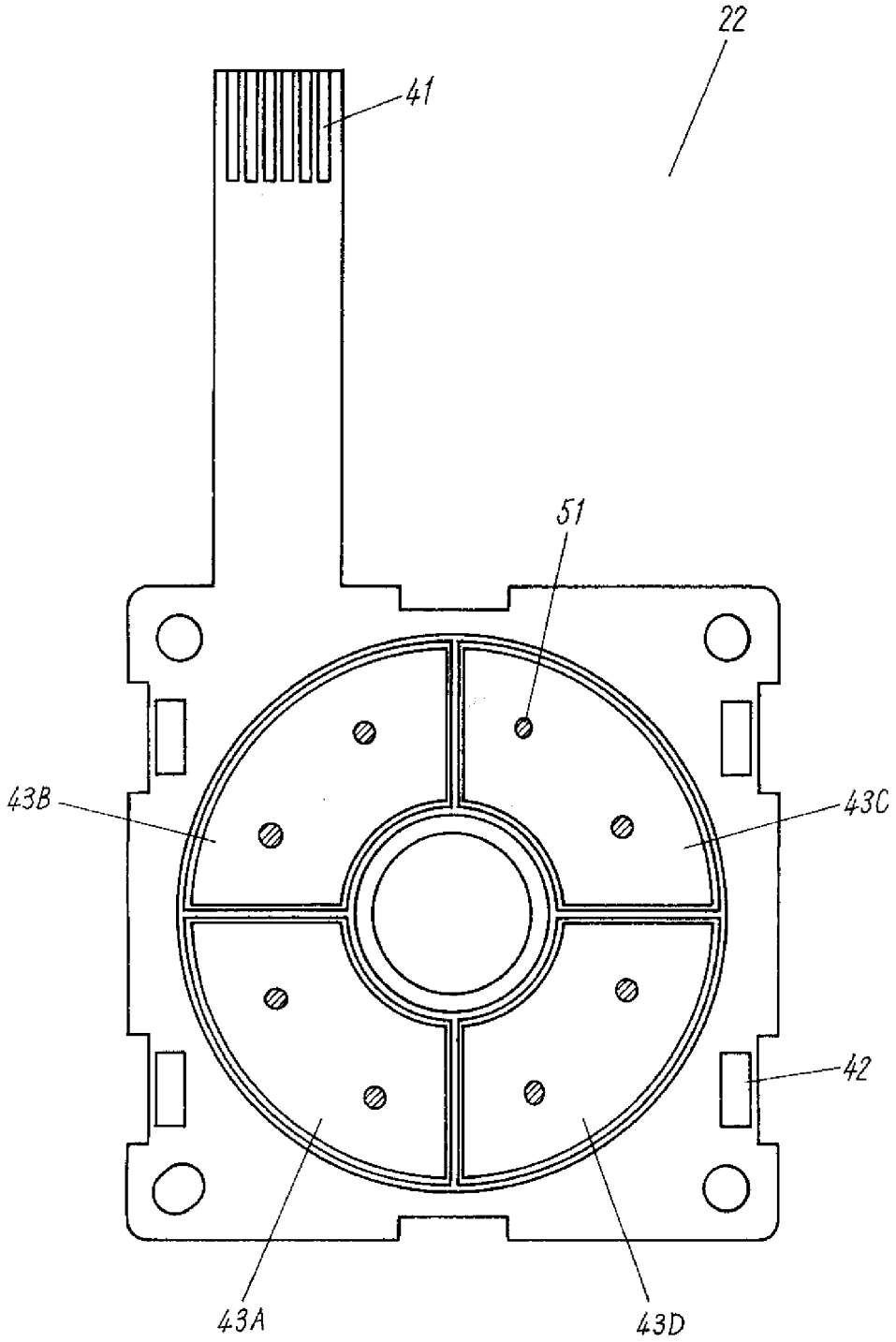
FIG. 4 is a top view of a fixed electrode body of a multi-directional operating switch in accordance with an embodiment.

FIG. 4 is a top view of fixed electrode body 22 and illustrates contact positions between movable electrode body 23 and fixed electrode body 22 when movable electrode body 23 is placed on the top face of fixed electrode body 22. Contact sections 51 show the positions where each of the undersides of eight pressing projections 23B touches each of the insulating layers disposed on fixed electrodes 43A-43D. As FIG. 4 shows, two of contact sections 51 are located on each of fixed electrodes 43A-43D.

Operating section 31, pressing section 32, and tilting section 33, shown in FIG. 1, FIG. 2 and forming operating body 24, are made of moldable resin such as insulating resin.

Operating section 31 includes cylindrical holding section 31A and shaft section 31B extending downward from holding section 31A. Pressing section 32 includes circular opening 32A at the center, and a radius of its outer circumference is roughly the same as a radius of holding section 31A. Pressing section 32 also includes circular projection 32B at the underside. Tilting section 33 includes four projections 33A at four sides respectively and its underside shapes like an arc.

Figure 5:
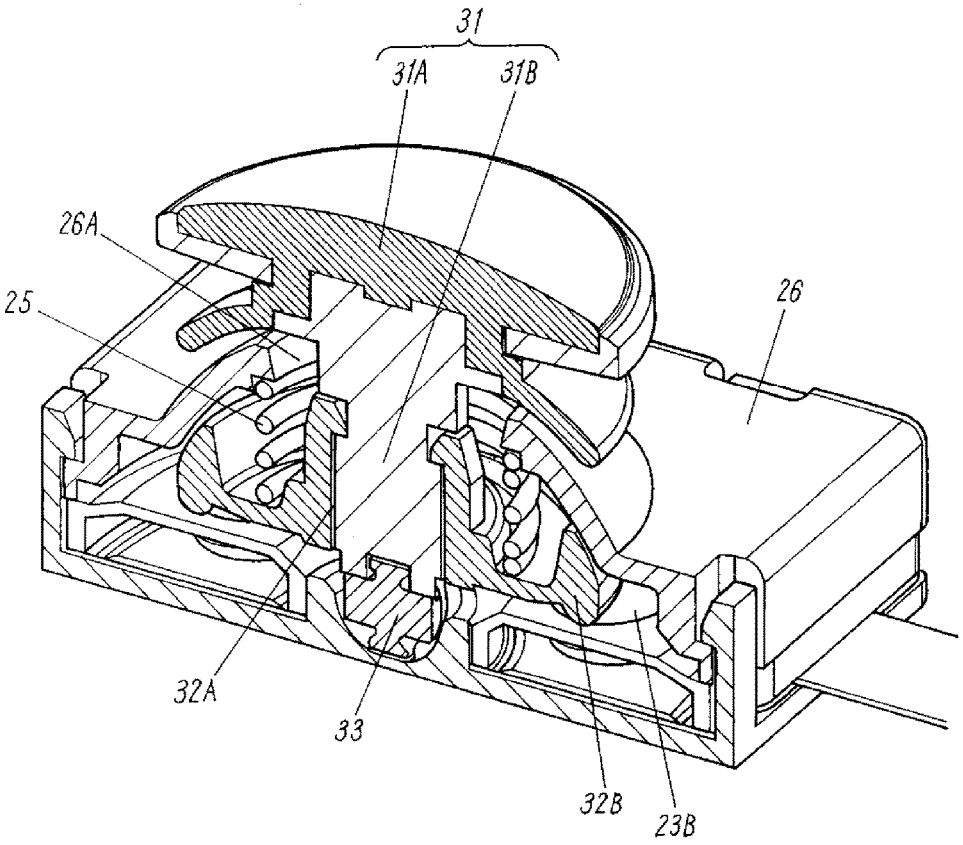
FIG. 5 is a perspective sectional view of a multi-directional operating switch in accordance with an embodiment.

FIG. 5 is a perspective sectional view of multi-directional operating switch 100. As FIG. 5 shows, shaft section 31B of operating section 31 is inserted into circular opening 32A, whereby the bottom end of shaft section 31B is engaged with projections 33A. As a result, operating section 31, pressing section 32, and tilting section 33 are integrated into one unit for working as operating body 24.

Tilting section 33 is inserted into bearing section 21B to act as a fulcrum for tilting of operating section 31. Circular projection 32B is placed such that it strides over the top face of pressing projections 23B and presses the periphery of pressing projections 23B from the above.

Spring 25 is formed by winding an alloy metal such as stainless steel or hard steel, and has elasticity. Shaft section 31B is inserted into spring 25, which is located between upper case 26 and pressing section 32 for restoring the operating section 31 to a neutral position.

Upper case 26 is made of insulating resin, includes circular opening 26A at its center, and shapes like a box of which underside is open. Materials for lower case 21, operating body 24, and upper case 26 can be selected from, e.g. polyacetal, nylon, polycarbonate, and acrylonitrile butadiene styrene (ABS) resin.

The insulating layer (not shown) disposed on the top face of fixed electrodes 43A-43D has been described in this embodiment as disposed on fixed electrode body 22 side; however, the insulating layer can be disposed on movable electrode body 23 side. It is easier to form the insulating layer on fixed electrode body 22 side rather than on movable electrode body 23 side.

Fixed electrode body 22 has been described in this embodiment as employing a flexible printed circuit board; however, it can employ a rigid board such as a glass epoxy board.

A method for assembling multi-directional operating switch 100 is demonstrated hereinafter. First, place fixed electrode body 22 such that electrode placement section 22A is laid on the top face of flat plate 21A of lower case 21, whereby cable section 22B is exposed outside lower case 21.

Next, place movable electrode 23 on the top face of electrode placement section 22A such that pressing projections 23B are disposed on fixed electrodes 43A-43D and an underside of flat section 23D is brought into contact with grounding electrode 42.

Then insert shaft section 31B of operating section 31 into circular opening 26A of upper case 26, and insert shaft section 31B into circular opening 32A of pressing section 32 with spring 25 being put around shaft 31B from the bottom. Attach tilting section 33 to the lower end of shaft section 31B.

In this state, insert tilting section 33 into bearing section 21B, place upper case 26 on lower case 21, and engage upper case 26 to lower case 21 with locking tab 21.

Multi-directional operating switch 100 thus assembled is connected to an electronic circuit (not shown) of an electronic apparatus via terminal 41. The electronic circuit supplies a given electric potential to fixed electrodes 43A-43D via the wiring in fixed electrode body 22. The electronic circuit also supplies a grounding potential to movable electrode body 23 via grounding electrodes 42. The electronic circuit detects an electrostatic capacity generated between movable electrode body 23 and fixed electrodes 43A-43D. For instance, as the sectional view of FIG. 2 shows, in the case of operating section 31 staying at a neutral position, it can be determined that operating section 31 stays at the neutral position based on the electrostatic capacity generated between movable electrode body 23 and fixed electrodes 43A-43D.

Figure 6:
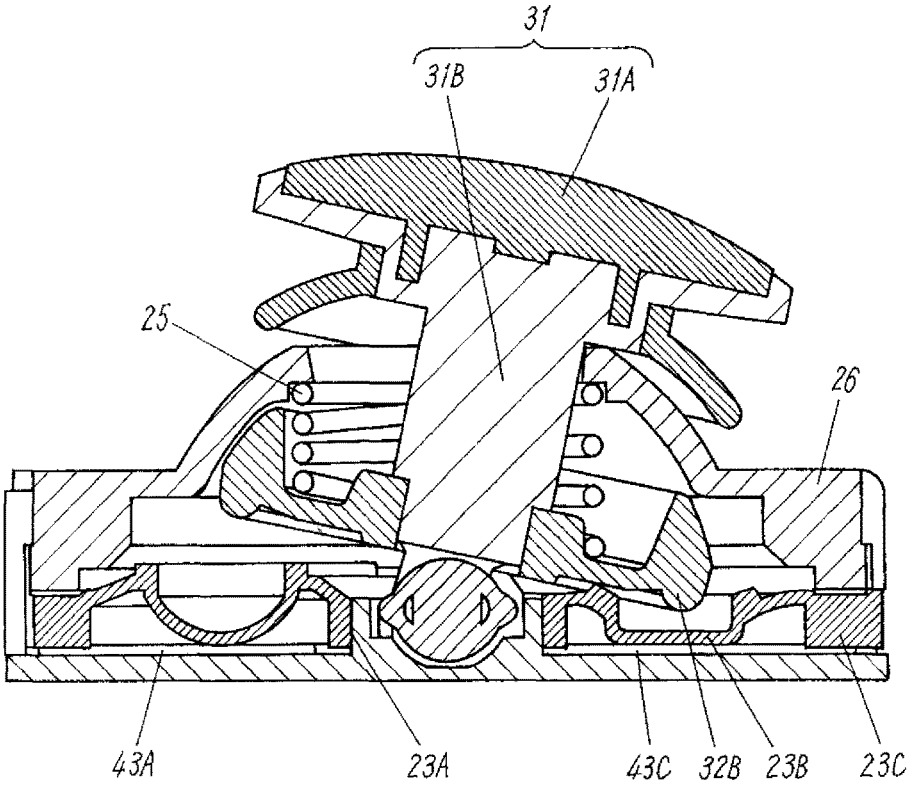
FIG. 6 is a sectional view of a multi-directional operating switch in operation in accordance with an embodiment.
Figure 7:
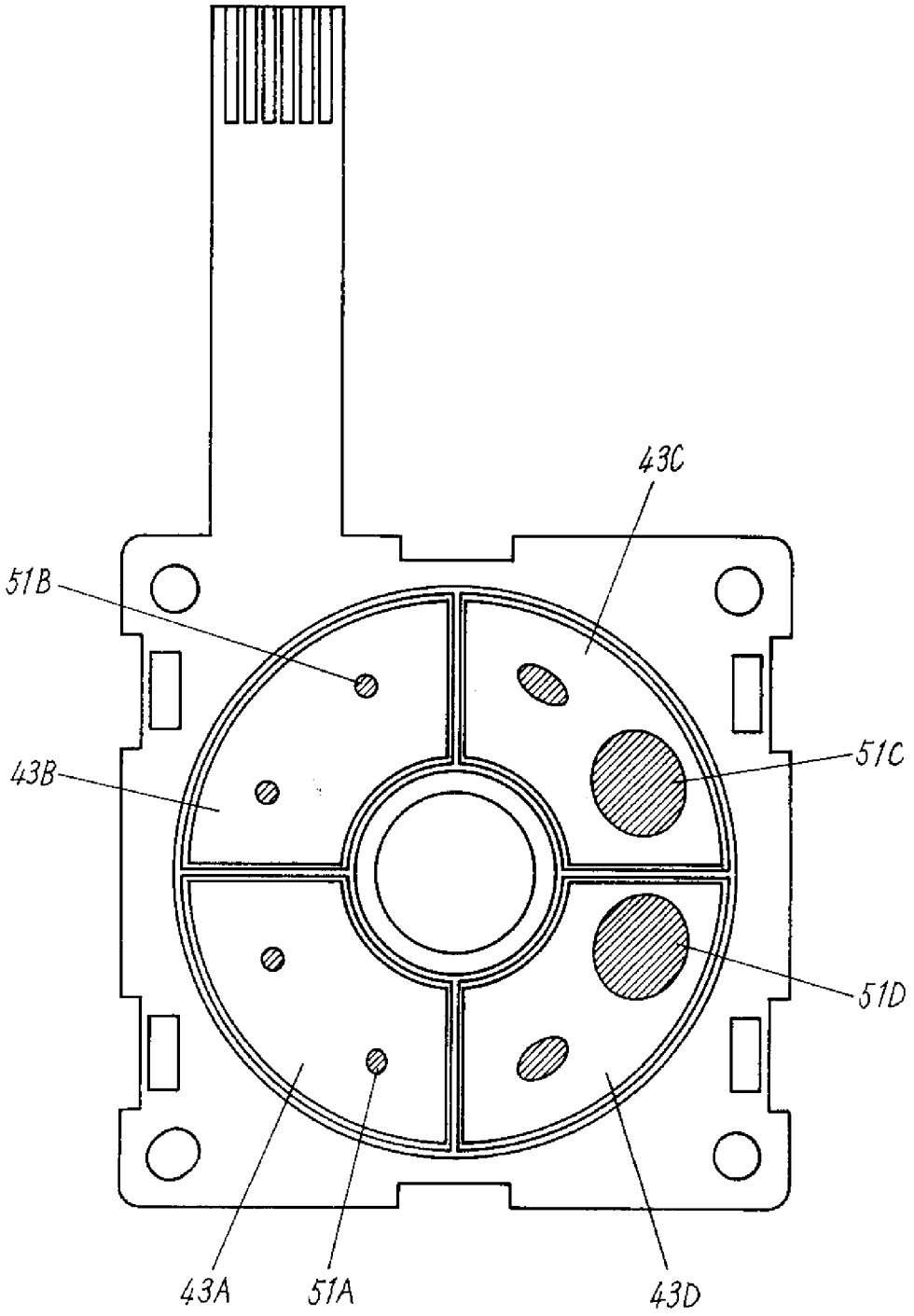
FIG. 7 is a top view of a fixed electrode body of a multi-directional operating switch in operation in accordance with an embodiment.
Figure 8:
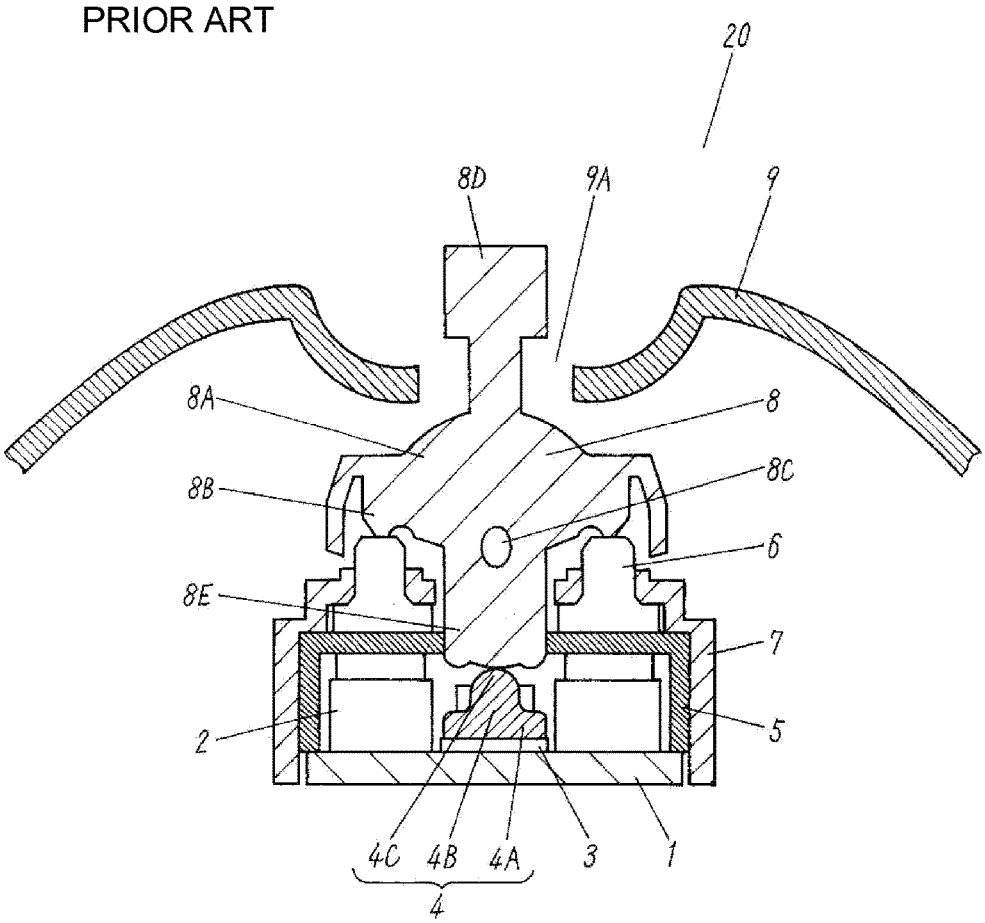
FIG. 8 PRIOR ART
FIG. 8 is a sectional view of a conventional multi-directional operating switch.
Figure 9:
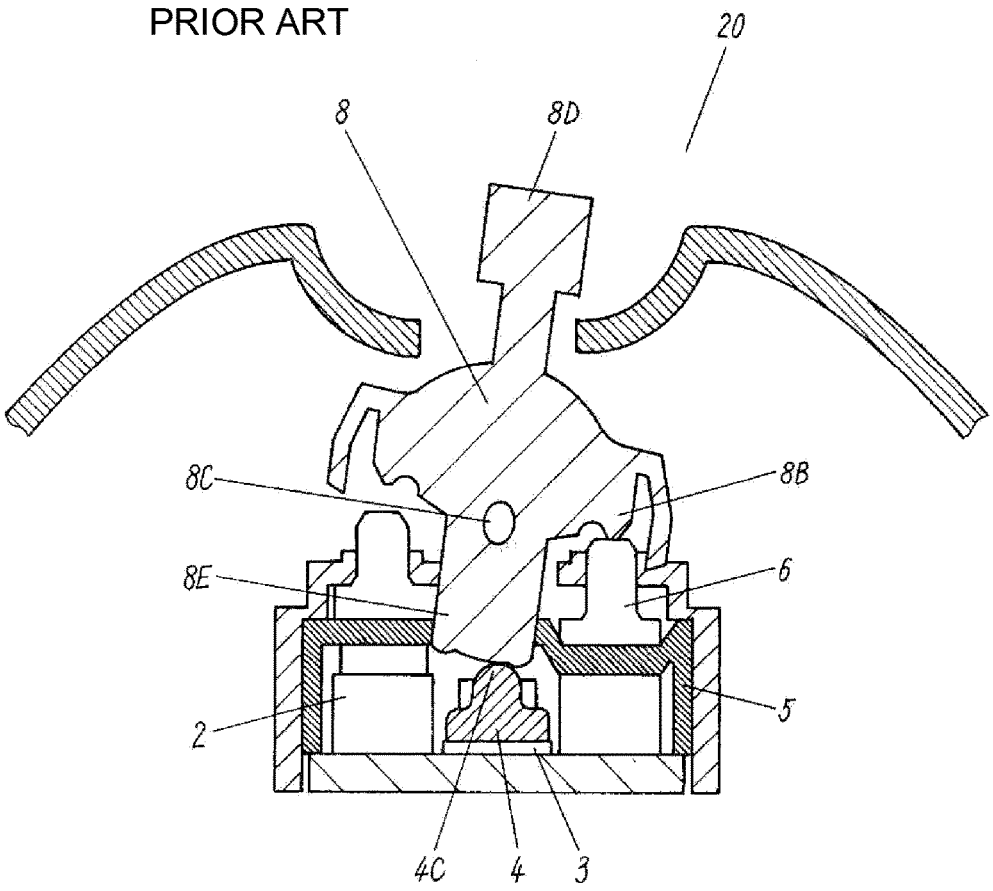
FIG. 9 is a sectional view of the conventional multi-directional operating switch in operation.

An operator tilts operating section 31 from the neutral position toward right, then the state at the neutral position shown in FIG. 2 changes to a state shown in FIG. 6. At this time, projecting section 32B presses the periphery of pressing projections 23B, which are thus pressed and deformed. The undersides of pressing projections 23B are urged unevenly to the insulating layers disposed on fixed electrodes 43A-43D. As FIG. 7 shows, these mechanisms allow the contacting areas of contact sections 51C, 51D to fixed electrodes 43A-43D to be greater than the contacting areas of contact sections 51A, 51B. This is because of the tilt of operating body 24 toward between fixed electrode 43C and fixed electrode 43D, namely, operating body 24 is tilted to the right in FIG. 7.

The areas of contact section 51A-51D thus become unequal to each other, so that the electrostatic capacities between fixed electrodes 43A-43D and movable electrode body 23 are changed. The electronic circuit determines the tilt direction and the tilt angle of operating section 31 based on output signals from fixed electrodes 43A-43D, and controls the electronic apparatus reflecting the tilt direction and tilt angle of operating section 31.

Here is an instance of controlling an electronic apparatus. A display on a liquid crystal display of the electronic apparatus is scrolled along a tilt direction of operating section 31 at a speed corresponding to a tilt angle. The deformation of pressing projections 23B caused by pressing thereof is highly reproducible, so that the tilt direction and the tilt angle repeated in the same manner allow the electrostatic capacities detected at fixed electrodes 43A-43D to fall within a given range of disperse.

In other words, a change in an electrostatic capacity is detected with output signals from fixed electrodes 43A-43D, and then the tilt direction as well as the tilt angle of operating section 31 is determined. The multi-directional operating switch thus can determine the tilt angle with high accuracy.

In this embodiment, the multi-directional operating switch including four fixed electrodes 43A-43D has been demonstrated hereinbefore; however, the present invention is applicable to a multi-directional operating switch that includes one fixed electrode for detecting a tilt of an operating section based on a change in an electrostatic capacity generated between this one fixed electrode and a movable electrode body.

To be more specific, the operating switch includes the fixed electrode body, the conductive movable electrode body, and the operating body. Fixed electrode body 22 includes first fixed electrode 43A on the top face. Movable electrode body 23 is disposed on fixed electrode body 22 and includes first pressing projection 23B protruding toward first fixed electrode 43A. Operating body 24 is disposed on movable electrode body 23, and can be tilted along a first direction for pressing first pressing projection 23B from the above. Movable electrode body 23 is elastic, so that first pressing projection 23B can be deformed for changing an electrostatic capacity generated between first fixed electrode 43A and first pressing projection 23B.

The structure discussed above allows the operating switch to determine the tilt angle of operating body 24 accurately. The operating switch further includes second fixed electrode 43C disposed on the top face of fixed electrode body 22, and second pressing projection 23B protruding toward second fixed electrode 43C and disposed to movable electrode body 23. Operating body 24 can be tilted along a second direction for pressing second pressing projection 23B from the above. Second pressing projection 23B can be deformed for changing an electrostatic capacity generated between second fixed electrode 43C and second pressing projection 23B.

The structure discussed above allows determining the tilt angle of operating body 24 accurately, and also detecting two tilt directions of operating body 24. The first direction differs from the second direction by 180 degrees, so that the tilt directions to be detected can be the exact opposite.

The operating switch also includes third fixed electrode 43B and fourth fixed electrode 43D both disposed on the top face of fixed electrode body 22. The operating switch further includes third pressing projection 23B protruding toward third fixed electrode 43B and disposed at movable electrode body 23, and fourth pressing projection 23B protruding toward fourth fixed electrode 43D and disposed at movable electrode body 23. Third pressing projection 23B can be deformed to change an electrostatic capacity generated between third fixed electrode 43B and third pressing projection 23B. Fourth pressing projection 23B can be deformed to change an electrostatic capacity generated between fourth fixed electrode 43D and fourth pressing projection 23B. The first, second, third, and fourth fixed electrodes 43A, 43C, 43B, and 43D are placed on the same circumference. Operating body 24 can be tilted to right, left, backward, and forward to press movable electrode body 23 from the above.

The foregoing structure allows determining the tilt angle of operating body 24 accurately, and also detecting a tilt direction in multiple directions of operating body 24.

The operating switch further includes grounding electrode 42 disposed at fixed electrode body 22. Grounding electrode 42 is electrically connected to movable electrode body 23, which can be thus grounded with a simple structure.

INDUSTRIAL APPLICABILITY

The operating switch of the present invention can advantageously determine a tilt angle of the operating body accurately, and is useful chiefly for operating a variety of electronic apparatuses.

The invention claimed is:

1. An operating switch comprising:

a fixed electrode body;

a first fixed electrode disposed on a top face of the fixed electrode body;

a second fixed electrode disposed on the top face of the fixed electrode body;

a movable electrode body being conductive, disposed on the fixed electrode body, and including a first pressing projection protruding toward the first fixed electrode and a second pressing projection protruding, separately from the first pressing projection, toward the second fixed electrode and provided to the movable electrode body; and an operating body disposed on the movable electrode body, wherein:

the operating body is configured to be tilted along a first direction for pressing the first pressing projection from above, and to be tilted along a second direction for pressing the second pressing projection from above, the movable electrode body is elastic, the first pressing projection is configured to be deformed such that an electrostatic capacity between the first fixed electrode and the first pressing projection is changed, and the second pressing projection is configured to be deformed such that an electrostatic capacity between the second fixed electrode and the second pressing projection is changed.

2. The operating switch of claim 1, wherein the first direction differs from the second direction by 180 degrees.

3. The operating switch of claim 1, further comprising:

a third fixed electrode and a fourth fixed electrode both disposed on the top face of the fixed electrode body;

a third pressing projection protruding, separately from the first and second pressing projections, toward the third fixed electrode and provided to the movable electrode body; and a fourth pressing projection protruding, separately from the first to third pressing projections, toward the fourth fixed electrode and provided to the movable electrode body, wherein:

the third pressing projection is configured to be deformed such that an electrostatic capacity between the third fixed electrode and the third pressing projection is changed, the fourth pressing projection is configured to be deformed such that an electrostatic capacity between the fourth fixed electrode and the fourth pressing projection is changed, the first fixed electrode, the second fixed electrode, the third fixed electrode, and the fourth fixed electrode are disposed on a same circumference, and the operating body is configured to be tilted to right, left, backward, and forward for pressing the movable electrode body from above.

4. The operating switch of claim 1, further comprising a grounding electrode provided to the fixed electrode body, wherein the movable electrode body is electrically connected to the grounding electrode.

5. The operating switch of claim 1, wherein:

the first pressing projection has first contact section, the first contact section being in contact with the first fixed electrode, and the second pressing projection has second contact section, the second contact section being in contact with the second fixed electrode.

* * * * *